US005439708A

United States Patent [19]

Tsujimoto et al.

[11] Patent Number: 5,439,708

[45] Date of Patent: Aug. 8, 1995

[54] SLIDE HOPPER-TYPE METHOD FOR COATING MOVING WEB HAVING REDUCED STREAKING

[75] Inventors: Tadahiro Tsujimoto; Takashi Ito; Nobuo Takeuchi; Misao Takahashi, all of Kanagawa, Japan

[73] Assignee: Fuji Photo Film Co., Ltd., Kanagawa, Japan

[21] Appl. No.: 889,429

[22] Filed: May 28, 1992

[30] Foreign Application Priority Data

Jun. 3, 1991 [JP] Japan ..... 3-157431

[51] Int. Cl.[6] ..... B05D 3/00

[52] U.S. Cl. ..... 427/294; 427/420; 118/410

[58] Field of Search ..... 427/420, 294; 118/410, 118/411, DIG. 2

[56] References Cited

U.S. PATENT DOCUMENTS

| | | | |
|---|---|---|---|
| 2,681,294 | 6/1954 | Beguin | 118/410 |
| 3,849,166 | 11/1974 | Omichi et al. | 427/222 |
| 3,928,679 | 12/1975 | Jackson et al. | 118/411 |
| 3,993,019 | 11/1976 | Jackson | 118/411 |
| 4,292,349 | 9/1981 | Ishiwata et al. | 118/410 |
| 5,332,440 | 7/1994 | Hirshburg | 118/411 |
| 5,380,369 | 1/1995 | Hirshburg | 118/411 |

FOREIGN PATENT DOCUMENTS 1206332 8/1989 Japan .

*Primary Examiner*—Shrive Beck
*Assistant Examiner*—Katherine A. Bareford
*Attorney, Agent, or Firm*—Sughrue, Mion, Zinn, Macpeak & Seas

[57] ABSTRACT

A solution applying method in which a continuously conveyed web is applied with a coating solution by a solution injector. The solution injector includes a lip with a lower end portion thereof having an angle of 85° or less relative to a surface of the injector. A coating solution flows along the lip of the solution injector to form a bead between the lip and the web. The solution applying conditions and pressures before and after the bead is formed between the web and the lip are controlled before the coating solution is applied to the web such that a lower end portion of the bead coincides with the lower end portion of the lip. The solution applying device may have a lower end portion of the lip with an angle of not more than 89°. A portion of the lip may extend parallel to a roller conveying the web and has a length of 0.1–10 mm. Even when a solution having good wettability is used as a coating solution, foreign matter is prevented from adhering to the lip due to drying, hardening and gelation of the coating solution to thereby prevent streaking for a relatively long duration.

6 Claims, 2 Drawing Sheets

SLIDE HOPPER-TYPE METHOD FOR COATING MOVING WEB HAVING REDUCED STREAKING

BACKGROUND OF THE INVENTION

The present invention relates to a method and apparatus for applying a liquid coating mixture onto a continuously conveyed, elongated flexible support member (hereinafter referred to simply as a "web") in manufacturing a photographic film, a photographic paper, a material for a photomechanical process, a pressure-sensitive paper, a heat-sensitive recording paper, a magnetic recording tape, or the like. More particularly, the present invention relates to a method and apparatus for applying one or more types of coating solutions onto the web simultaneously using a slide hopper-type solution applying device.

When a coating solution is applied to a continuously conveyed web using a slide hopper-type solution applying device, a solution bridge (hereinafter referred to as a "bead") is produced between the leading end portion (hereinafter referred to as a "lip") of a solution injector and the web, and the coating solution is applied to the web by the bead. In applying the coating solution with the slide hopper device, the bead must be stably maintained. Hence, if the bead is subjected to external disturbances such as deformation of the web or contact of adhered materials, damage to the solution applying device, adherence of materials to the device, vibration of the device, pressure variations of an atmospheric gas or the like, then the film formed on the web may be affected. For example, streaking may result in the film extending in the conveyance direction of the web, thus reducing the quality and reliability of the film formed on the web.

The streaking may include streaks produced at the start of solution application, streaks produced when the film passes a jointed portion of two webs, or streaks produced by foreign matter adhered to the web passing the bead portion. Additionally, damage to the lip in direct contact with the bead or adherence of foreign matter to the lip due to drying and hardening or gelation of the coating solution may cause streaking. Particularly, streaks caused by the foreign matter adhering to the lip creates a serious problem in successively applying the coating solution to the web over a relatively long duration.

Various improvements have been proposed to prevent the above-mentioned streaking from occurring. For example, the following techniques have been proposed:

(1) As disclosed in U.S. Pat. No. 3,993,019, an acute portion of a lip is removed to make the lip obtuse to protect it against slight damage.

(2) As disclosed in Japanese Patent Un-examined Publication No. Hei. 1-206332, a lip is constructed to support the lower end portion of a bead.

(3) As disclosed in U.S. Pat. No. 4,292,349, to prevent adhesion of foreign matter due to the drying and hardening of a coating solution to be applied, a slide is constructed with a hood which minimizes evaporation of the coating solution.

However, the above-mentioned conventional techniques have been ineffective in preventing streaking from occurring over a relatively long duration. Particularly, when the coating solution has good wettability, for example, when the coating solution contains an organic solvent, the above-mentioned conventional preventive techniques are ineffective.

Specifically, in the above-mentioned technique (1), as shown in FIG. 5 when a lip 7 has an obtuse corner portion to hold the lower end portion of a bead 6, then the coating solution spreads wettingly beyond the lower end portion 1 of the lip 7, resulting in a streak being caused by the adhesion of foreign matter due to the evaporation and hardening of the coating solution.

Additionally, in above-mentioned technique (2), only providing the support means for holding the lower end portion of the bead 6 is insufficient in preventing evaporated and hardened material from forming due to spreading of the coating solution. Indeed, if the coating solution has good wettability, and if the lower end portion 1 of the lip for holding the lower end portion of the bead has an angle of more than 89°, then preventing adhesion of foreign matter due to the evaporation and hardening of the coating solution for a relatively long duration is impossible. Additionally, if the leading end portion of the lip is machined to have a complicated shape to hold the lower end portion of the bead 6, then the coating solution varies in quality in a solution collecting portion, and cleansing the solution collection portion is difficult. This results in reduced productivity of a coating film.

Further, a technique to restrict the evaporation of the coating solution to be applied, such as the above-described technique (3), is ineffective with respect to application of a composite solution which is hardened due to gelation. Also, with this technique, if the surrounding atmospheric gas has a pressure density due to the presence of a hood, then parts of the coating solution tend to condense forming droplets on the hood, which can then drop off the hood onto a film previously formed, causing damage to the film. Additionally, according to the film coating method using the slide hopper device, often the lower portion of the bead may have a pressure lower than that of the upper portion of the bead. Ordinarily, because the bead's lower portion is under a suction pressure, keeping the atmospheric gas pressure of the bead upper portion at a high level is difficult.

SUMMARY OF THE INVENTION

In view of the foregoing, the present invention is directed to eliminating the problems of the above-mentioned conventional methods. Accordingly, it is an object of the invention to provide a method which, even if a solution having good wettability is used as a coating solution, foreign matter is prevented from adhering to the solution in a lip due to drying, hardening and gelation of the coating solution to thereby prevent streaking from occurring over a relatively long duration. The invention also provides, an apparatus for practicing the method.

To achieve the above object, according to the invention, there is provided a method for applying a coating solution to a continuously conveyed web from a solution injector of a solution applying device, characterized in that, as the solution injector of the solution applying device, there is employed a solution injector having a lower end portion of the leading end portion thereof with an angle of 85° or less, and the solution applying conditions and pressures before and after a bead is formed between the web and the leading end portion of the solution injector can be controlled such that the lower end of the bead coincides with the lower end portion of the solution injector's leading end portion, before the coating solution is applied.

Also, according to the invention, a device is provided for applying a coating solution to a continuously conveyed web, characterized in that the angle of the lower end portion of the leading end portion of a solution injector of the solution applying device is 89° or less, and a portion of the solution injector's leading end portion extending parallel to a backing roller is 0.1–10 mm.

DESCRIPTION OF THE PREFERRED EMBODIMENTS

Figure 1:
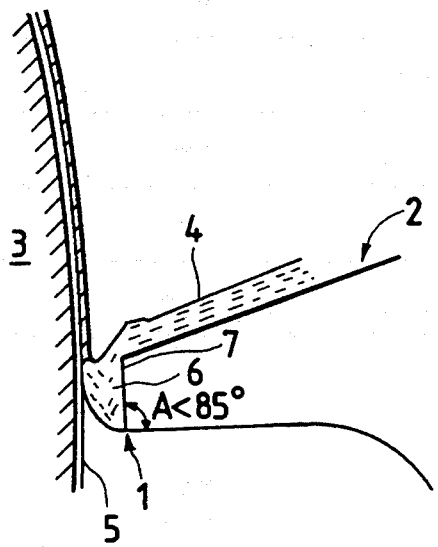
FIG. 1 is a partial side view of a solution applying device for practicing a solution applying method according to the invention.
Figure 2:
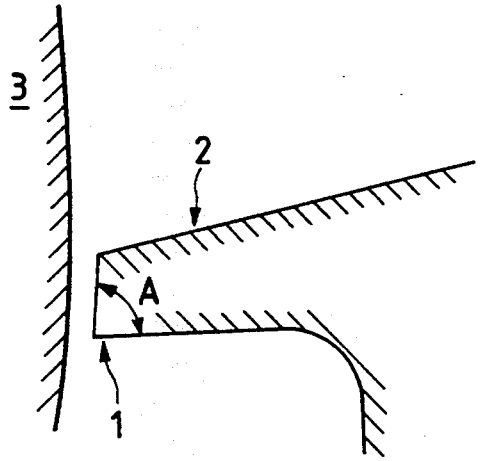
FIGS. 2 and 3 are respective partial side views depicting the angle of the lower end portion of the lip of the solution applying device according to the invention.
Figure 3:
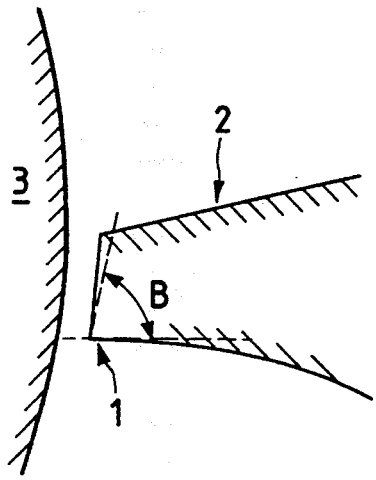
Figure 4A:
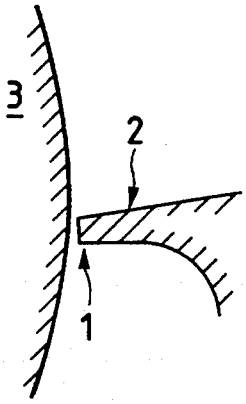
FIGS. 4(A), 4(B), 4(C) and 4(D) are partial side views of respective embodiments of a coating solution applying device constructed according to the invention.
Figure 4B:
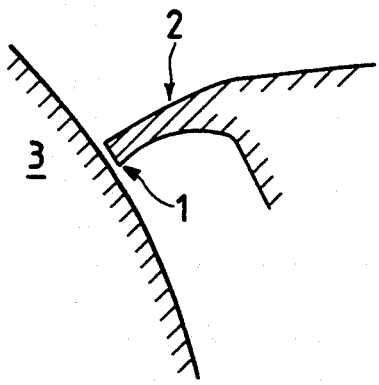
Figure 4C:
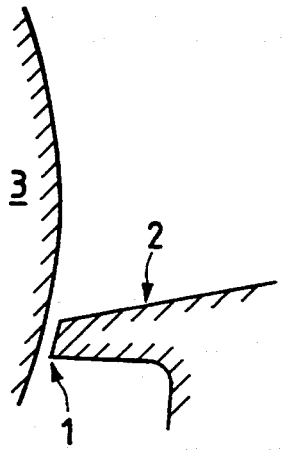
Figure 4D:
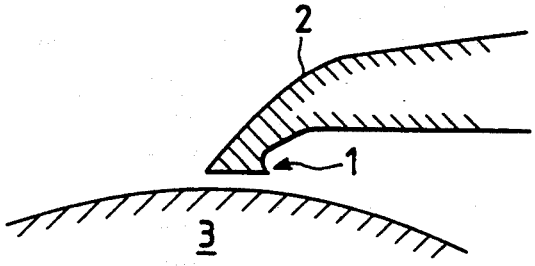
Figure 5:
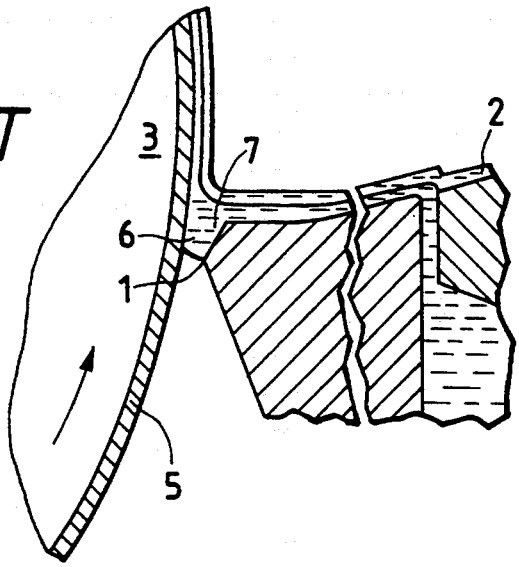
FIG. 5 PRIOR ART
FIG. 5 is a partial side view of a conventional solution applying device.

In accordance with the present invention, the angle of the lower end portion of the leading end of the solution injector portion is an angle A as shown in FIGS. 1 and 2. Alternatively, if a lip has a section defined by a curved line as shown in FIG. 3, the angle of the lower end portion of the leading end of the solution injector portion is an angle B formed by a tangential line at the lower end of the lip. For purposes of the present invention, the solution applying conditions include viscosity, surface tension and the like.

In a solution applying method according to the invention, as shown in FIG. 1, the lower end of the bead formed between a lip 7 and a web 5 is made to coincide with the lower end portion 1 of the lip. To make the lower end portion of the bead coincide with the lower end portion 1 of the lip's leading end portion, the viscosity and surface tension (as solution applying conditions) may be controlled such that the coating solution on the lip has a length of 0.1 mm–10 mm, and more preferably has a length of 0.5 mm–2 mm; or, the pressure of the lower portion of the bead may be reduced 1–100 mm (Aq) and, more preferably may be reduced 1–15 mm (Aq) over the upper portion of the bead.

According to the invention, the shape of the solution injector, except for the angle of the lower end portion of the lip, is not restricted specifically. However, the preferable shape of the lip and its preferable positions with respect to the backing roller 3 are as shown in FIGS. 4(A)–4(D). Here, the angle of the lower end portion of the lip is finished uniformly along with its width and as sharp as possible. For example, the radius of curvature of the angle of the lower end portion is preferably less than 50 μm. While FIGS. 4(A)–4(D) show an example of a slide-type solution injector, the same principles also apply to an extrusion-type solution injector.

The quality of the material of the lip of the injector of the present invention is not specifically limited, but the material which is excellent in wearing-proof or in corrosion-proof is preferably used. For example, sintered hard alloy material comprising ceramic material or bonded carbide particle is used.

According to the invention, by arranging the lower end portion 1 of the lip to have an angle of 89° or less, even when applying a coating solution 4 having good wettability such that a bead 6 is fully formed in a portion of the lip extending almost parallel to the backing roller 3, the coating solution is prevented not only from spreading over a portion of the lip extending beyond the lower end portion 1 thereof, but also from hardening and adhering in such a portion due to drying and gelation of the coating solution. Accordingly, streaking can be prevented over long durations relative to the conventional methods.

Thus, the above-mentioned object of the invention can be achieved by providing a solution applying method which, as described above, uses solution injector having a lip forming an angle of 89° or less at the lower end portion thereof and which controls the solution applying conditions and pressures.

To illustrate the effects of the present invention more clearly, a preferred embodiment of the present invention is described below. However, this embodiment is merely illustrative and, of course, the invention is not to be limited to such an embodiment.

In this embodiment, as a coating solution, a mixture is employed having the following substances:

Gelatin . . . 1.0 part by weight
Water . . . 2.0 parts by weight
Acetone . . . . 40.0 parts by weight
Methanol . . . 15.0 parts by weight
Methylene Chloride . . . 20.0 parts by weight Coating solution having the above components has a viscosity of 0.8 cp and has a surface tension of 25 dyne/cm according to the "lift" method. As a support member, a cellulose triacetate film having a thickness of 0.12 mm was used.

To apply the coating solution, a slide hopper solution applying device having a slide 2 formed of stainless steel, as partially shown in FIG. 2, was used. The slide was formed to have part of its leading end portion extending substantially parallel to the web to be formed through a length of 1.0 mm. The distance between the parallel portion and the web is 0.15 mm.

The coating solution was applied with a pressure difference of 1 mm (Aq) between the pressures of the upper and lower portions of the bead. The coating solution application was performed using the above-mentioned solution with respect to the respective angles of 85°, 95° and 105° of the lower end portion of the lip's leading end portion.

INVENTIVE EXAMPLE 1

With the angle A formed between the parallel portion and the lower end portion of the lip being 85°, solution application was performed continuously for 24 hours. No streaking was observed.

COMPARATIVE EXAMPLE 1

When the angle A was 95° streaking occurred one hour after starting solution application. The position of the lip corresponding to the streaks was checked, and hardened gelatin was found to have been adhered to the lower end portion 1 of the lip.

COMPARATIVE EXAMPLE 2

With the angle A being set at 105°, streaking was detected 15 minutes after starting solution application. Similarly to Comparative Example 1, the adhesion of hardened gelatin was found on the lower end portion 1 of the lip at a position corresponding to where the streak was produced on the film.

INVENTIVE EXAMPLE 2

In this example, the length (i.e., the length of a portion of the slide's leading end portion almost parallel to the web) of the lip was 0.5 mm, and there was no difference between the pressures before and after the bead was formed. Other solution applying conditions were similar to those in Example 1 (i.e., the angle A was 85°). Under these conditions, solution application was conducted continuously for 24 hours. No streaking was detected.

COMPARATIVE EXAMPLE 3

When the angle A was changed to 105° with respect to Example 2, streaking was generated about 30 minutes after the coating solution application began. The position of the lip corresponding to the streaking was checked, and hardened gelatin was found to have been adhered to the lower end portion 1 of the lip, similarly to the above-mentioned Comparative Examples 1 and 2.

As can be clearly understood from the foregoing description, according to the solution applying method and apparatus of the invention, even when using a coating solution having good wettability, the coating solution can be applied without producing streaking for a relatively long duration. This contributes greatly to improving the quality and productivity of the product to be coated.

Although the present invention has been fully described by way of preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A method for applying a coating solution onto a web, said method comprising the steps of:

continuously conveying said web;

providing a solution applying device, said device including a solution injector comprising a leading end portion having first and second ends, a first surface extending from said first end of said leading end portion, and a second surface extending from said second end of said leading end portion, said leading end portion being opposed to said web, and having a lower end portion having an angle of not more than 85° formed between said leading end portion and said second surface of said solution injector, a space below said second surface being open;

flowing a coating solution along said first surface of said solution injector to form a bead between said leading end portion and said web, while said space below said second surface remains free of coating solution; and controlling applying conditions and pressure of said solution on both sides of said bead between said web and said leading end portion of said solution injector such that a first end portion of said bead coincides with said second end of said leading end portion of said solution injector.

2. The method according to claim 1, further comprising a step of providing said leading end portion with a length of between 0.1 mm–10 mm.

3. The method according to claim 1, further comprising a step of providing said leading end portion with a length of between 0.5 mm–2 mm.

4. The method according to claim 1, further comprising a step of providing a pressure difference at said first end portion of said bead between upper and lower portions of said bead in a range of 1 to 100 mm (Aq).

5. The method according to claim 1, further comprising a step of providing a pressure difference at said first end portion of said bead between upper and lower portions of said bead in a range of 1 to 15 mm (Aq).

6. The method according to claim 1, further comprising a step of preparing said coating solution, wherein said preparing step includes mixing at least gelatin, water, acetone, methanol, and methylene chloride, said coating solution having a viscosity of 0.8 cp and a surface tension of 25 dyne/cm.

* * * * *